US010580338B2

(12) United States Patent
Park

(10) Patent No.: US 10,580,338 B2
(45) Date of Patent: Mar. 3, 2020

(54) ORGANIC LIGHT EMITTING DISPLAY DEVICE AND METHOD OF DRIVING THE SAME

(71) Applicant: Samsung Display Co., Ltd., Yongin-si, Gyeonggi-do (KR)

(72) Inventor: Jinwoo Park, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/185,947

(22) Filed: Nov. 9, 2018

(65) Prior Publication Data

US 2019/0147781 A1 May 16, 2019

(30) Foreign Application Priority Data

Nov. 16, 2017 (KR) ..... 10-2017-0153415

(51) Int. Cl.
*G09G 3/00* (2006.01)
*G09G 3/3233* (2016.01)
*G09G 3/20* (2006.01)

(52) U.S. Cl.
CPC ..... *G09G 3/006* (2013.01); *G09G 3/2007* (2013.01); *G09G 3/3233* (2013.01); *G09G 2320/029* (2013.01); *G09G 2320/0233* (2013.01); *G09G 2320/0257* (2013.01); *G09G 2330/12* (2013.01)

(58) Field of Classification Search
None
See application file for complete search history.

(56) References Cited

U.S. PATENT DOCUMENTS 8,058,808 B2 11/2011 Hong et al.
2011/0069061 A1* 3/2011 Nakamura ..... G09G 3/3225 345/214
2012/0056916 A1* 3/2012 Ryu ..... G09G 3/3208 345/691
2014/0239846 A1* 8/2014 Shoji ..... H05B 33/0896 315/297
2016/0035281 A1* 2/2016 Jeon ..... G09G 3/3225 345/690

FOREIGN PATENT DOCUMENTS

KR 10-2016-0059838 A 5/2016
KR 10-2017-0072994 A 6/2017

* cited by examiner

*Primary Examiner* — Dorothy Harris
(74) *Attorney, Agent, or Firm* — Lewis Roca Rothgerber Christie LLP

(57) ABSTRACT

An organic light emitting display device includes a display panel including a plurality of active pixels in a display region, and a plurality of test pixels in a non-display region, a panel driver configured to provide the test pixels with data signals corresponding to a plurality of gray levels, and to drive the display panel, a readout circuit configured to measure sensing currents flowing through the test pixels, and a controller configured to obtain hysteresis characteristic values of the test pixels based on the sensing currents, to generate output image data by compensating input image data for the active pixels based on the hysteresis characteristic values of the test pixels to which the active pixels are mapped, and to control the panel driver to display an image based on the output image data.

20 Claims, 10 Drawing Sheets

FIG. 7 unit time

TEG1

TEG1-REF

| TEG-ID | 1 | 2 | 3 | 4 | 5 | 6 | 7 | 8 | 9 | 10 | 11 | 12 | 13 | 14 | 15 | 16 | 17 | 18 |
|---|---|---|---|---|---|---|---|---|---|---|---|---|---|---|---|---|---|---|
| 0G-REF | 0 | 0 | 0 | 0 | 0 | 0 | 0 | 0 | 0 | 0 | 0 | 0 | 0 | 0 | 0 | 0 | 0 | 0 |

TEG1-G2

| TEG-ID | 1 | 2 | 3 | 4 | 5 | 6 | 7 | 8 | 9 | 10 | 11 | 12 | 13 | 14 | 15 | 16 | 17 | 18 |
|---|---|---|---|---|---|---|---|---|---|---|---|---|---|---|---|---|---|---|
| 0G-1f | 0 | 0 | 0 | 0 | 0 | 255 | 255 | 255 | 255 | 0 | 0 | 0 | 0 | 0 | 255 | 255 | 255 | 255 |
| 0G-2f | 255 | 0 | 0 | 0 | 0 | 0 | 255 | 255 | 255 | 255 | 0 | 0 | 0 | 0 | 0 | 255 | 255 | 255 |
| 0G-3f | 255 | 255 | 0 | 0 | 0 | 0 | 0 | 255 | 255 | 255 | 255 | 0 | 0 | 0 | 0 | 0 | 255 | 255 |
| 0G-4f | 255 | 255 | 255 | 0 | 0 | 0 | 0 | 0 | 255 | 255 | 255 | 255 | 0 | 0 | 0 | 0 | 0 | 255 |
| 0G-5f | 255 | 255 | 255 | 255 | 0 | 0 | 0 | 0 | 0 | 255 | 255 | 255 | 255 | 0 | 0 | 0 | 0 | 0 |

⋮

TEG5

TEG5-REF

| TEG-ID | 1 | 2 | 3 | 4 | 5 | 6 | 7 | 8 | 9 | 10 | 11 | 12 | 13 | 14 | 15 | 16 | 17 | 18 |
|---|---|---|---|---|---|---|---|---|---|---|---|---|---|---|---|---|---|---|
| 48G-REF | 48 | 48 | 48 | 48 | 48 | 48 | 48 | 48 | 48 | 48 | 48 | 48 | 48 | 48 | 48 | 48 | 48 | 48 |

TEG5-G1

| TEG-ID | 1 | 2 | 3 | 4 | 5 | 6 | 7 | 8 | 9 | 10 | 11 | 12 | 13 | 14 | 15 | 16 | 17 | 18 |
|---|---|---|---|---|---|---|---|---|---|---|---|---|---|---|---|---|---|---|
| 48G-1b | 48 | 48 | 48 | 48 | 48 | 0 | 0 | 0 | 0 | 48 | 48 | 48 | 48 | 48 | 0 | 0 | 0 | 0 |
| 48G-2b | 0 | 48 | 48 | 48 | 48 | 48 | 0 | 0 | 0 | 0 | 48 | 48 | 48 | 48 | 48 | 0 | 0 | 0 |
| 48G-3b | 0 | 0 | 48 | 48 | 48 | 48 | 48 | 0 | 0 | 0 | 0 | 48 | 48 | 48 | 48 | 48 | 0 | 0 |
| 48G-4b | 0 | 0 | 0 | 48 | 48 | 48 | 48 | 48 | 0 | 0 | 0 | 0 | 48 | 48 | 48 | 48 | 48 | 0 |
| 48G-5b | 0 | 0 | 0 | 0 | 48 | 48 | 48 | 48 | 48 | 0 | 0 | 0 | 0 | 48 | 48 | 48 | 48 | 48 |

TEG5-G2

| TEG-ID | 1 | 2 | 3 | 4 | 5 | 6 | 7 | 8 | 9 | 10 | 11 | 12 | 13 | 14 | 15 | 16 | 17 | 18 |
|---|---|---|---|---|---|---|---|---|---|---|---|---|---|---|---|---|---|---|
| 48G-1f | 48 | 48 | 48 | 48 | 48 | 255 | 255 | 255 | 255 | 48 | 48 | 48 | 48 | 48 | 255 | 255 | 255 | 255 |
| 48G-2f | 255 | 48 | 48 | 48 | 48 | 48 | 255 | 255 | 255 | 255 | 48 | 48 | 48 | 48 | 48 | 255 | 255 | 255 |
| 48G-3f | 255 | 255 | 48 | 48 | 48 | 48 | 48 | 255 | 255 | 255 | 255 | 48 | 48 | 48 | 48 | 48 | 255 | 255 |
| 48G-4f | 255 | 255 | 255 | 48 | 48 | 48 | 48 | 48 | 255 | 255 | 255 | 255 | 48 | 48 | 48 | 48 | 48 | 255 |
| 48G-5f | 255 | 255 | 255 | 255 | 48 | 48 | 48 | 48 | 48 | 255 | 255 | 255 | 255 | 48 | 48 | 48 | 48 | 48 |

⋮

TEG6

TEG6-REF

| TEG-ID | 1 | 2 | 3 | 4 | 5 | 6 | 7 | 8 | 9 | 10 | 11 | 12 | 13 | 14 | 15 | 16 | 17 | 18 |
|---|---|---|---|---|---|---|---|---|---|---|---|---|---|---|---|---|---|---|
| 63G-REF | 63 | 63 | 63 | 63 | 63 | 63 | 63 | 63 | 63 | 63 | 63 | 63 | 63 | 63 | 63 | 63 | 63 | 63 |

TEG6-G1

| TEG-ID | 1 | 2 | 3 | 4 | 5 | 6 | 7 | 8 | 9 | 10 | 11 | 12 | 13 | 14 | 15 | 16 | 17 | 18 |
|---|---|---|---|---|---|---|---|---|---|---|---|---|---|---|---|---|---|---|
| 63G-1b | 63 | 63 | 63 | 63 | 63 | 0 | 0 | 0 | 0 | 63 | 63 | 63 | 63 | 63 | 0 | 0 | 0 | 0 |
| 63G-2b | 0 | 63 | 63 | 63 | 63 | 0 | 0 | 0 | 0 | 0 | 63 | 63 | 63 | 63 | 63 | 0 | 0 | 0 |
| 63G-3b | 0 | 0 | 63 | 63 | 63 | 63 | 0 | 0 | 0 | 0 | 0 | 63 | 63 | 63 | 63 | 63 | 0 | 0 |
| 63G-4b | 0 | 0 | 0 | 63 | 63 | 63 | 63 | 0 | 0 | 0 | 0 | 0 | 63 | 63 | 63 | 63 | 63 | 0 |
| 63G-5b | 0 | 0 | 0 | 0 | 63 | 63 | 63 | 63 | 0 | 0 | 0 | 0 | 0 | 63 | 63 | 63 | 63 | 63 |

TEG6-G2

| TEG-ID | 1 | 2 | 3 | 4 | 5 | 6 | 7 | 8 | 9 | 10 | 11 | 12 | 13 | 14 | 15 | 16 | 17 | 18 |
|---|---|---|---|---|---|---|---|---|---|---|---|---|---|---|---|---|---|---|
| 63G-1f | 63 | 63 | 63 | 63 | 63 | 255 | 255 | 255 | 255 | 63 | 63 | 63 | 63 | 63 | 255 | 255 | 255 | 255 |
| 63G-2f | 255 | 63 | 63 | 63 | 63 | 63 | 255 | 255 | 255 | 255 | 63 | 63 | 63 | 63 | 63 | 255 | 255 | 255 |
| 63G-3f | 255 | 255 | 63 | 63 | 63 | 63 | 63 | 255 | 255 | 255 | 255 | 63 | 63 | 63 | 63 | 63 | 255 | 255 |
| 63G-4f | 255 | 255 | 255 | 63 | 63 | 63 | 63 | 63 | 255 | 255 | 255 | 255 | 63 | 63 | 63 | 63 | 63 | 255 |
| 63G-5f | 255 | 255 | 255 | 255 | 63 | 63 | 63 | 63 | 63 | 255 | 255 | 255 | 255 | 63 | 63 | 63 | 63 | 63 |

⋮

TEGn

TEGn-REF

| TEG-ID | 1 | 2 | 3 | 4 | 5 | 6 | 7 | 8 | 9 | 10 | 11 | 12 | 13 | 14 | 15 | 16 | 17 | 18 |
|---|---|---|---|---|---|---|---|---|---|---|---|---|---|---|---|---|---|---|
| 255G-REF | 255 | 255 | 255 | 255 | 255 | 255 | 255 | 255 | 255 | 255 | 255 | 255 | 255 | 255 | 255 | 255 | 255 | 255 |

TEGn-G1

| TEG-ID | 1 | 2 | 3 | 4 | 5 | 6 | 7 | 8 | 9 | 10 | 11 | 12 | 13 | 14 | 15 | 16 | 17 | 18 |
|---|---|---|---|---|---|---|---|---|---|---|---|---|---|---|---|---|---|---|
| 255G-1b | 255 | 255 | 255 | 255 | 255 | 0 | 0 | 0 | 0 | 255 | 255 | 255 | 255 | 255 | 0 | 0 | 0 | 0 |
| 255G-2b | 0 | 255 | 255 | 255 | 255 | 255 | 0 | 0 | 0 | 0 | 255 | 255 | 255 | 255 | 255 | 0 | 0 | 0 |
| 255G-3b | 0 | 0 | 255 | 255 | 255 | 255 | 255 | 0 | 0 | 0 | 0 | 255 | 255 | 255 | 255 | 255 | 0 | 0 |
| 255G-4b | 0 | 0 | 0 | 255 | 255 | 255 | 255 | 255 | 0 | 0 | 0 | 0 | 255 | 255 | 255 | 255 | 255 | 0 |
| 255G-5b | 0 | 0 | 0 | 0 | 255 | 255 | 255 | 255 | 255 | 0 | 0 | 0 | 0 | 255 | 255 | 255 | 255 | 255 |

ORGANIC LIGHT EMITTING DISPLAY DEVICE AND METHOD OF DRIVING THE SAME

CROSS-REFERENCE TO RELATED APPLICATION

This application claims priority to, and the benefit of, Korean Patent Application No. 10-2017-0153415, filed on Nov. 16, 2017 in the Korean Intellectual Property Office (KIPO), the content of which is incorporated herein in its entirety by reference.

BACKGROUND

1. Field

Embodiments of the present inventive concept relate to organic light emitting display devices, and to methods of driving the organic light emitting display devices.

2. Description of the Related Art

In an organic light emitting display device, a driving transistor included in each pixel may generate a driving current based on a data signal, and an organic light emitting diode (OLED) included in the pixel may emit light based on the driving current to display an image.

The driving transistor may have a hysteresis characteristic, whereby a response characteristic in a current frame varies depending on an operating state in a previous frame. Thus, even if the data signal having the same voltage level is applied to a plurality of driving transistors, driving currents generated by the driving transistors may be different from each other according to respective operating states in the previous frame. For example, even if the same data voltage is applied in a current frame to a first pixel representing a black color in a previous frame and to a second pixel representing a white color in the previous frame, the first and second pixels may emit light with different luminances in the current frame.

Techniques for preventing luminance non-uniformity caused by the hysteresis characteristics of the driving transistors have been researched. For example, in a conventional organic light emitting display device, driving transistors of respective pixels may be initialized to an on-bias state before the pixels emit light. Accordingly, all driving transistors may have the same response characteristic, and thus the luminance non-uniformity caused by the hysteresis characteristic may be reduced. However, in this case, degradation of the driving transistors may be accelerated because the driving transistors are turned on every frame, and a compensation operation for a panel deviation may be required to be performed separately from the initialization operation.

SUMMARY

Some embodiments provide an organic light emitting display device capable of compensating for hysteresis characteristics, and capable of reducing an after image. Some embodiments provide a method of driving the organic light emitting display device.

According to embodiments, there is provided an organic light emitting display device that includes a display panel including a plurality of active pixels in a display region, and a plurality of test pixels in a non-display region, a panel driver configured to provide the test pixels with data signals corresponding to a plurality of gray levels, and to drive the display panel, a readout circuit configured to measure sensing currents flowing through the test pixels, and a controller configured to obtain hysteresis characteristic values of the test pixels based on the sensing currents, to generate output image data by compensating input image data for the active pixels based on the hysteresis characteristic values of the test pixels to which the active pixels are mapped, and to control the panel driver to display an image based on the output image data.

The hysteresis characteristic values may correspond to current differences between the sensing currents and target currents.

The test pixels may be grouped into first through N-th test groups, where N is an integer that is greater than 1, and each test group may include a reference test pixel for receiving a data signal corresponding to a reference gray level, a first group for alternately receiving the data signal corresponding to the reference gray level and a data signal corresponding to a black gray level, and a second group for alternately receiving the data signal corresponding to the reference gray level and a data signal corresponding to a white gray level.

A gray value for a first pixel of the active pixels in a current period may be extracted from the input image data, and a selected test group corresponding to the first pixel is selected among the first through N-th test groups based on the gray value in the current period, wherein a selected one of the first group and the second group of the selected test group is further selected by comparing the gray value in the current period and a gray value in a previous period before the current period, and wherein the test pixel to which the first pixel is mapped is updated from a previous test pixel to an updated test pixel in the selected one of the first group and the second group such that the updated test pixel has a closest current difference to a current difference of the previous test pixel among current differences of the test pixels in the selected one of the first group and the second group.

A gray value for a first pixel of the active pixels may be extracted from the input image data, and a selected test group corresponding to the first pixel is selected among the first through N-th test groups based on the gray value, and, when the gray value for the first pixel is maintained for a reference period of time, the test pixel to which the first pixel is mapped may be updated to the reference test pixel of the selected test group.

The controller may include a target current storage configured to store target currents corresponding to the plurality of gray levels, a current difference calculator configured to calculate current differences between the sensing currents and the target currents, a compensation information storage configured to store the current differences of the test pixels, and a data compensator configured to obtain compensation values for the active pixels based on the current differences of the test pixels to which the active pixels are mapped, and to compensate the input image data based on the compensation values.

The compensation information storage may include a mapping table configured to store identifiers of the test pixels to which the active pixels are mapped, and a hysteresis characteristic table configured to store the current differences of the test pixels having the identifiers.

The current difference of each test pixel may include a first current difference obtained at a first sensing reference voltage and a second current difference obtained at a second sensing reference voltage that is different from the first sensing reference voltage.

The non-display region may surround the display region.

The non-display region may be adjacent to at least one edge of the display region.

The readout circuit may be configured to measure the sensing currents every frame period, and the test pixels to which the active pixels are mapped may be configured to be updated every frame period.

The readout circuit may be configured to measure the sensing currents with an interval of a plurality of frame periods, and the test pixels to which the active pixels are mapped may be configured to be updated with the interval of the plurality of frame periods.

According to embodiments, there is provided a method of driving an organic light emitting display device including a plurality of active pixels in a display region and a plurality of test pixels in a non-display region, the method including obtaining hysteresis characteristic values of the test pixels based on sensing currents flowing through the test pixels, generating output image data by compensating input image data for the active pixels based on the hysteresis characteristic values of the test pixels to which the active pixels are mapped, and displaying an image based on the output image data.

The hysteresis characteristic values may correspond to current differences between the sensing currents and target currents.

The test pixels may be grouped into first through N-th test groups, where N is an integer that is greater than 1, and each test group may include a reference test pixel that receives a data signal corresponding to a reference gray level, a first group that alternately receives the data signal corresponding to the reference gray level and a data signal corresponding to a black gray level, and a second group that alternately receives the data signal corresponding to the reference gray level and a data signal corresponding to a white gray level.

The method may further include extracting a gray value for a first pixel of the active pixels in a current period from the input image data, selecting a test group corresponding to the first pixel among the first through N-th test groups based on the gray value in the current period, selecting one of the first group and the second group of the selected test group by comparing the gray value in the current period and a gray value in a previous period before the current period, and updating the test pixel to which the first pixel is mapped from a previous test pixel to a updated test pixel in the selected one of the first group and the second group such that the updated test pixel has a closest current difference to a current difference of the previous test pixel among current differences of the test pixels in the selected one of the first group and the second group.

The method may further include extracting a gray value for a first pixel of the active pixels from the input image data, selecting a test group corresponding to the first pixel among the first through N-th test groups based on the gray value, and updating the test pixel to which the first pixel is mapped to the reference test pixel of the selected test group when the gray value for the first pixel is maintained for a predetermined time.

Obtaining the hysteresis characteristic values may include obtaining the test pixels to which the active pixels are mapped by using a mapping table that stores identifiers of the test pixels to which the active pixels are mapped, and obtaining current differences of the test pixels to which the active pixels are mapped by using a hysteresis characteristic table that stores the current differences of the test pixels having the identifiers.

The current difference of each test pixel may include a first current difference obtained at a first sensing reference voltage and a second current difference obtained at a second sensing reference voltage that is different from the first sensing reference voltage.

The method may further include measuring the sensing currents every frame period, and updating the test pixels to which the active pixels are mapped every frame period.

As described above, the organic light emitting display device according to embodiments may include the test pixels located in the non-display region of the display panel, may measure the sensing currents flowing through the test pixels, may obtain the hysteresis characteristic values of the test pixels based on the sensing current, and may compensate the input image data for the active pixels based on the hysteresis characteristic values of the test pixels to which the active pixels are mapped. Accordingly, the organic light emitting display device may reduce an after image caused by the hysteresis characteristics, and may compensate for the panel deviation according to a panel variation and an operating environment (e.g., a temperature).

Further, the method of driving the organic light emitting display device according to embodiments may measure the sensing currents of the test pixels while the organic light emitting display device operates, and thus may accurately compensate for the hysteresis characteristics and the panel deviation to improve image quality.

BRIEF DESCRIPTION OF THE DRAWINGS

Illustrative, non-limiting embodiments will be more clearly understood from the following detailed description in conjunction with the accompanying drawings.

FIG. 7 is a diagram for describing an example of test groups.

DETAILED DESCRIPTION

Figure 1:
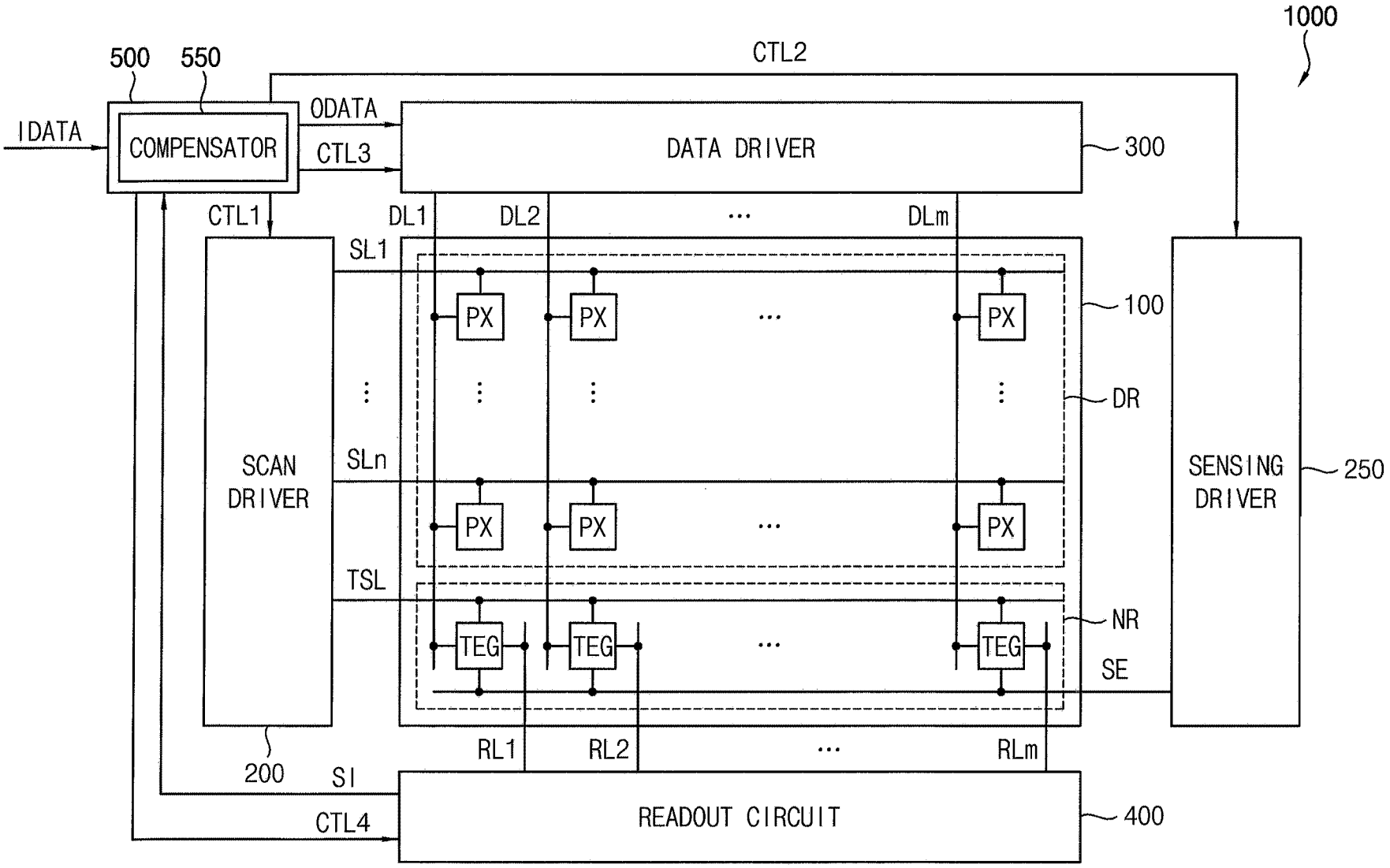
FIG. 1 is a block diagram illustrating an organic light emitting display device according to embodiments.

Features of the inventive concept and methods of accomplishing the same may be understood more readily by reference to the following detailed description of embodiments and the accompanying drawings. Hereinafter, embodiments will be described in more detail with reference to the accompanying drawings. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. Further, parts not related to the description of the embodiments might not be shown to make the description clear. In the drawings, the relative sizes of elements, layers, and regions may be exaggerated for clarity.

In the following description, for the purposes of explanation, numerous specific details are set forth to provide a thorough understanding of various embodiments. It is apparent, however, that various embodiments may be practiced without these specific details or with one or more equivalent arrangements. In other instances, well-known structures and devices are shown in block diagram form in order to avoid unnecessarily obscuring various embodiments.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. Similarly, when a first part is described as being arranged "on" a second part, this indicates that the first part is arranged at an upper side or a lower side of the second part without the limitation to the upper side thereof on the basis of the gravity direction.

It will be understood that when an element, layer, region, or component is referred to as being "on," "connected to," or "coupled to" another element, layer, region, or component, it can be directly on, connected to, or coupled to the other element, layer, region, or component, or one or more intervening elements, layers, regions, or components may be present. However, "directly connected/directly coupled" refers to one component directly connecting or coupling another component without an intermediate component. Meanwhile, other expressions describing relationships between components such as "between," "immediately between" or "adjacent to" and "directly adjacent to" may be construed similarly. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "have," "having," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

As used herein, the term "substantially," "about," "approximately," and similar terms are used as terms of approximation and not as terms of degree, and are intended to account for the inherent deviations in measured or calculated values that would be recognized by those of ordinary skill in the art. "About" or "approximately," as used herein, is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

When a certain embodiment may be implemented differently, a specific process order may be performed differently from the described order. For example, two consecutively described processes may be performed substantially at the same time or performed in an order opposite to the described order.

Various embodiments are described herein with reference to sectional illustrations that are schematic illustrations of embodiments and/or intermediate structures. As such, variations from the shapes of the illustrations as a result, for example, of manufacturing techniques and/or tolerances, are to be expected. Further, specific structural or functional descriptions disclosed herein are merely illustrative for the purpose of describing embodiments according to the concept of the present disclosure. Thus, embodiments disclosed herein should not be construed as limited to the particular illustrated shapes of regions, but are to include deviations in shapes that result from, for instance, manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the drawings are schematic in nature and their shapes are not intended to illustrate the actual shape of a region of a device and are not intended to be limiting. Additionally, as those skilled in the art would realize, the described embodiments may be modified in various different ways, all without departing from the spirit or scope of the present disclosure.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a block diagram illustrating an organic light emitting display device according to embodiments.

Referring to FIG. 1, an organic light emitting display device 1000 may include a display panel 100, a panel driver 200, 250, and 300, a readout circuit 400, and a controller 500.

The display panel 100 may include a plurality of active pixels PX located in a display region DR, and a plurality of test pixels TEG located in a non-display region NR. Here, the active pixels PX may display an image corresponding to data signals, and may include light emitting elements or organic light emitting diodes. The test pixels TEG may be used to measure hysteresis characteristics, whereby response characteristics of transistors in a current frame may vary depending on operating states in a previous frame. The test pixels TEG may omit the light emitting elements (e.g., may omit the organic light emitting diodes). The test pixels TEG may be located in the non-display region NR that surrounds the display region DR, or that is adjacent to at least one edge of the display region DR. For example, the display panel 100 may include n*m active pixels PX respectively located at crossings of n scan lines SL1 and SLn and m data lines DL1, DL2, and DLm, where n and m are integers greater than 1. In an example, the display panel 100 may further include at least m test pixels TEG respectively located at crossings of at least one test scan line TSL and the m data lines DL1, DL2, and DLm.

The panel driver 200, 250, and 300 may provide the test pixels TEG with data signals corresponding to a plurality of gray levels, and may drive the display panel 100. In some embodiments, the panel driver 200, 250, and 300 may include a scan driver 200, a sensing driver 250, and a data driver 300.

The scan driver 200 may provide scan signals to the active pixels PX through the scan lines SL1 and SLn based on a first control signal CTL1. Further, the scan driver 200 may provide a scan signal to the test pixels TEG through the test scan line TSL based on the first control signal CTL1.

The sensing driver 250 may provide a sensing control signal to the test pixels TEG through a sensing control line SE based on a second control signal CTL2.

The data driver 300 may provide data signals (or data voltages) to the active pixels PX through the data lines DL1, DL2, and DLm based on a third control signal CTL3. Further, the data driver 300 may provide data signals (or data voltages) corresponding to a plurality of gray levels to the test pixels TEG based on the third control signal CTL3.

The readout circuit 400 may measure sensing currents SI flowing through the test pixels TEG based on a fourth control signal CTL4. For example, the readout circuit 400 may be coupled to the test pixels TEG through sensing lines RL1, RL2, and RLm.

In some embodiments, the readout circuit 400 may measure the sensing currents SI every frame period. For example, the readout circuit 400 may measure the sensing currents SI during a sensing period included in each frame period. Thus, hysteresis characteristics of the test pixels TEG may be measured in real time. In other embodiments, the readout circuit 400 may measure the sensing currents SI at intervals of a plurality of frame periods. Because the hysteresis characteristic is generally maintained for few seconds, the sensing currents SI may be measured with a period of the plurality of frame periods (e.g., corresponding to a few seconds) to reduce a load or power consumption of the display device 1000. A configuration of the readout circuit 400 will be described below with reference to FIG. 3.

The controller 500 may include a compensator 550 that obtains hysteresis characteristic values of the test pixels TEG (e.g., the test pixels TEG to which the active pixels PX are mapped) based on the sensing current SI. In some embodiments, the hysteresis characteristic value may correspond to a current difference between the sensing current SI and a target current. The compensator 550 may generate output image data ODATA by compensating input image data IDATA for the active pixels PX based on the hysteresis characteristic values of the test pixels TEG to which the active pixels PX are mapped. The controller 500 may generate the control signals CTL1, CTL2, CTL3, and CTL4 for controlling the panel driver 200, 250, and 300 to display an image based on the output image data ODATA.

Although FIG. 1 illustrates an example of an arrangement of the test pixels TEG, the arrangement of the test pixels TEG may not be limited thereto. For example, the test pixels TEG may be arranged in a plurality of pixel rows and/or a plurality of pixel columns. The arrangement of the test pixels TEG will be described below with reference to FIGS. 10A through 10C.

Figure 2A:
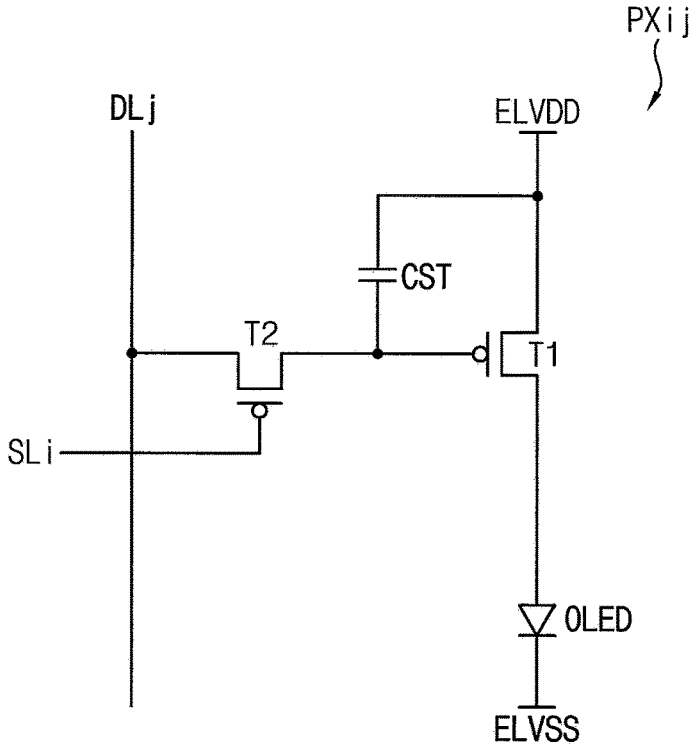
FIG. 2A is a circuit diagram illustrating an example of an active pixel included in an organic light emitting display device of FIG. 1.
Figure 2B:
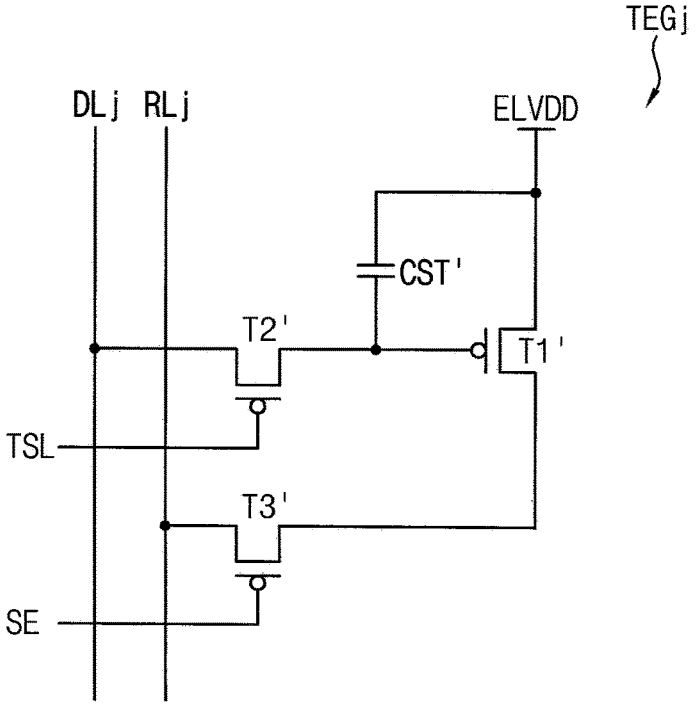
FIG. 2B is a circuit diagram illustrating an example of a test pixel included in an organic light emitting display device of FIG. 1.

FIG. 2A is a circuit diagram illustrating an example of an active pixel included in an organic light emitting display device of FIG. 1, and FIG. 2B is a circuit diagram illustrating an example of a test pixel included in an organic light emitting display device of FIG. 1.

Referring to FIGS. 2A and 2B, an active pixel PXij located in a display region may include an organic light emitting diode OLED to display an image corresponding to a data signal. However, a test pixel TEGj may be used to measure a sensing current for obtaining a hysteresis characteristic, and may not include the organic light emitting diode OLED.

As illustrated in FIG. 2A, the active pixel PXij may include a first transistor T1, a storage capacitor CST, a second transistor T2, and the organic light emitting diode OLED. The active pixel PXij may be coupled to an i-th scan line SLi and to a j-th data line DLj, where i and j are integers that are greater than 0.

The first transistor T1 may be a driving transistor that provides the organic light emitting diode OLED with a driving current corresponding to a voltage (e.g., a voltage of the data signal) stored in the storage capacitor CST. The first transistor T1 may include a first terminal coupled to a first power supply voltage ELVDD, a second terminal coupled to the organic light emitting diode OLED, and a gate terminal coupled to a second terminal of the second transistor T2.

The second transistor T2 may include a first terminal coupled to the j-th data line DLj, the second terminal coupled to the gate terminal of the first transistor T1, and a gate terminal coupled to the i-th scan line SLi.

The storage capacitor CST may be coupled between the first power supply voltage ELVDD and the gate terminal of the first transistor T1. The storage capacitor CST may store a voltage corresponding to the data signal provided through the j-th data line DLj while the second transistor T2 is turned on.

The organic light emitting diode OLED may be coupled between the second terminal of the first transistor T1 and a second power supply voltage ELVSS, and may emit light with luminance corresponding to the driving current generated by the first transistor T1.

As illustrated in FIG. 2B, the test pixel TEGj may include a first transistor T1', a storage capacitor CST', a second transistor T2', and a third transistor T3'. The test pixel TEGj may be coupled to a test scan line TSL, a sensing control line SE, a j-th data line DLj, and a j-th sensing line RLj. Because the test pixel TEGj has a configuration that is substantially the same as a configuration of the active pixel PXij, except that the test pixel TEGj does not include the organic light emitting diode OLED, and except that the test pixel TEGj includes the third transistor T3', the same reference numeral may be used for the same or similar elements, and duplicated descriptions may be omitted.

The first transistor T1' may be a driving transistor that provides a driving current corresponding to a voltage (or the data signal) stored in the storage capacitor CST to the third transistor T3' to measure the driving current. The first transistor T1' may include a first terminal coupled to the first power supply voltage ELVDD, a second terminal coupled to a first terminal of the third transistor T3', and a gate terminal coupled to a second terminal of the second transistor T2'.

The second transistor T2' may include a first terminal coupled to the j-th data line DLj, the second terminal coupled to the gate terminal of the first transistor T1', and a gate terminal coupled to the test scan line TSL.

The third transistor T3' may include a first terminal coupled to the second terminal of the first transistor T1', a second terminal coupled to the j-th sensing line RLj, and a gate terminal coupled to the sensing control line SE.

The storage capacitor CST' may be coupled between the first power supply voltage ELVDD and the gate terminal of the first transistor T1'.

Although FIGS. 2A and 2B respectively illustrate examples of configurations of the active pixel PXij and the test pixel TEGj, the configurations of the active pixel PXij and the test pixel TEGj may not be limited thereto. For example, although the test pixel TEGj is illustrated in FIG. 2B as being coupled to the j-th data line DLj and the j-th sensing line RLj, which are separate from each other, in other embodiments the test pixel TEGj may be coupled to one line that is used as both the data line or the sensing line in a time-divisional manner.

Figure 3:
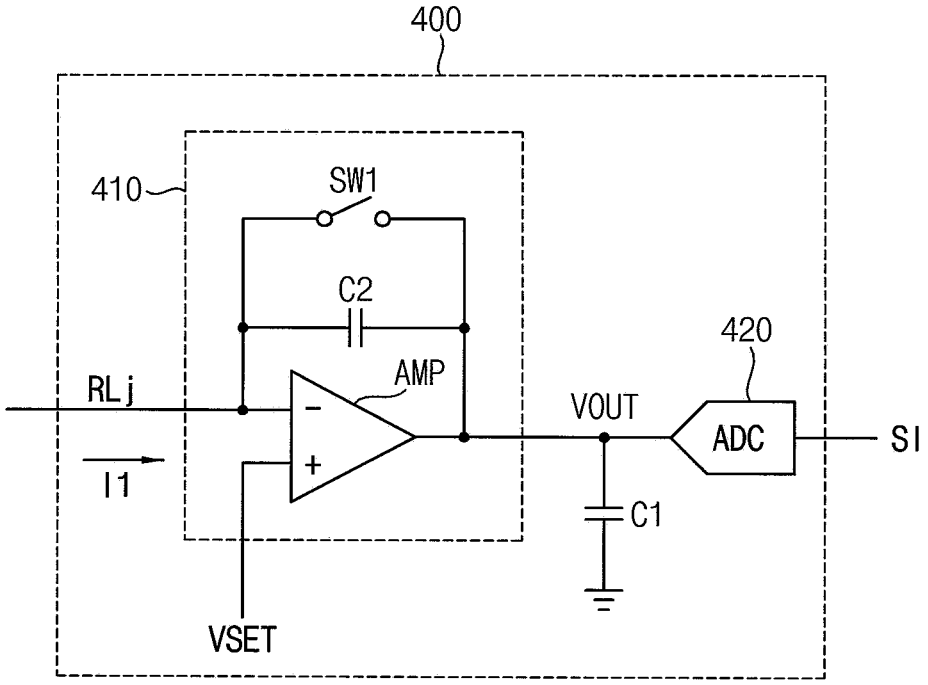
FIG. 3 is a circuit diagram illustrating an example of a readout circuit included in an organic light emitting display device of FIG. 1.

FIG. 3 is a circuit diagram illustrating an example of a readout circuit included in an organic light emitting display device of FIG. 1.

Referring to FIG. 3, a readout circuit 400 may include an integrator 410 and an analog-to-digital converter (ADC) 420.

The integrator 410 may integrate a first current I1 provided from a test pixel TEGj through a j-th sensing line RLj during a sensing period. The integrator 410 may integrate the first current I1 that is generated by a test pixel in response to a sensing reference voltage VSET, and may output an output voltage VOUT generated by the integration. The integrator 410 may include an amplifier AMP and a second capacitor C2. The amplifier AMP may include a first input terminal coupled to the j-th sensing line RLj, a second input terminal receiving the sensing reference voltage VSET, and an output terminal coupled to the ADC 420. The second capacitor C2 may be coupled between the first input terminal and the output terminal of the amplifier AMP.

In some embodiments, the integrator 410 may further include a first switch SW1 coupled between the first input terminal and the output terminal of the amplifier AMP. The first switch SW1 may be turned on to reset the integrator 410 during a reset period before the sensing period. Thus, the first switch SW1 may discharge a voltage charged in the second capacitor C2 during the reset period.

In some embodiments, the readout circuit 400 may further include a first capacitor C1 that temporarily stores the output voltage VOUT of the integrator 410. The first capacitor C1 may be coupled to the output terminal of the amplifier AMP, and may temporarily store the output voltage VOUT during the sensing period.

The ADC 420 may obtain a sensing current SI from the output voltage VOUT of the integrator 410, and may convert the sensing current SI into digital data. In some embodiments, the ADC 420 may include a sampling-and-holding circuit and an analog-to-digital converting circuit. The sampling-and-holding circuit may sample and hold the output voltage VOUT of the integrator 410, and may output the sampled and held voltage as a measured voltage. The sensing current SI may be obtained based on the measured voltage, a capacitance of the second capacitor C2, a voltage drop time, and a dropped voltage during the voltage drop time, and the analog-to-digital converting circuit may convert the sensing current SI into the digital data to output the digital data.

However, the readout circuit 400 may not be limited to a configuration illustrated in FIG. 3, and other embodiments may have various configurations that are able to measure the sensing current SI flowing through the test pixel TEGj.

Figure 4:
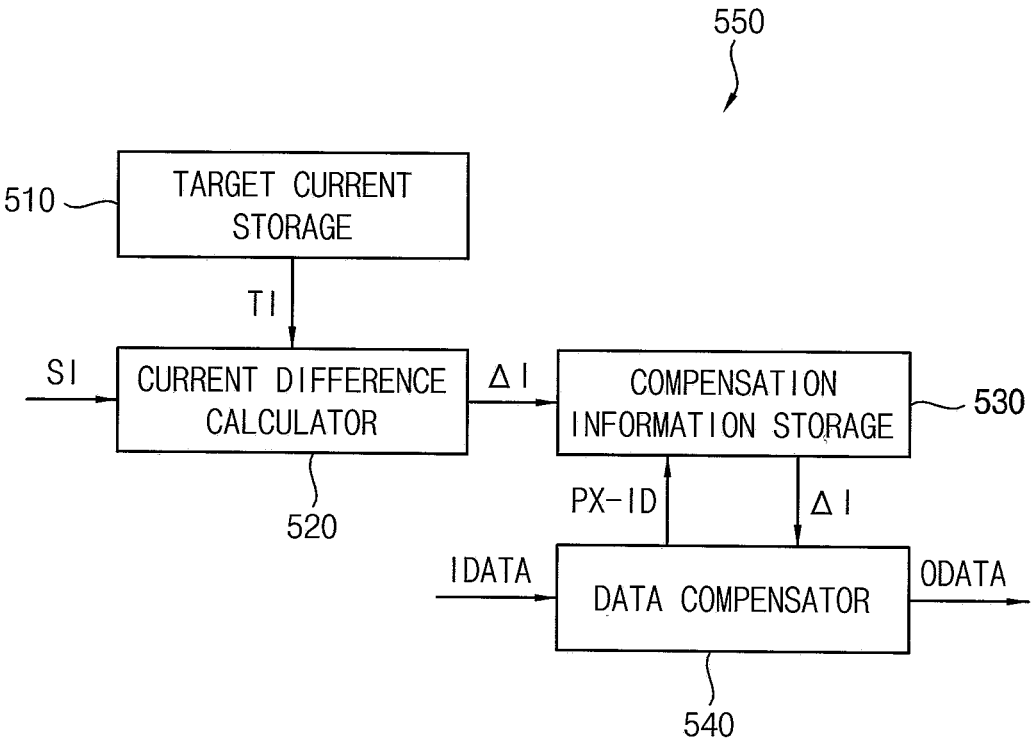
FIG. 4 is a block diagram illustrating an example of a compensator included in an organic light emitting display device of FIG. 1.
Figure 5A:
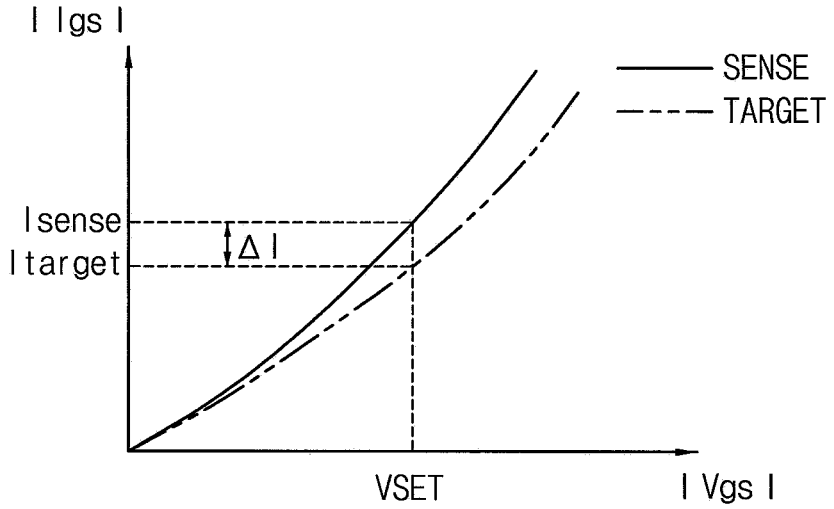
FIGS. 5A and 5B are diagrams for describing examples where a compensator of FIG. 4 obtains current differences as hysteresis characteristic values.
Figure 5B:
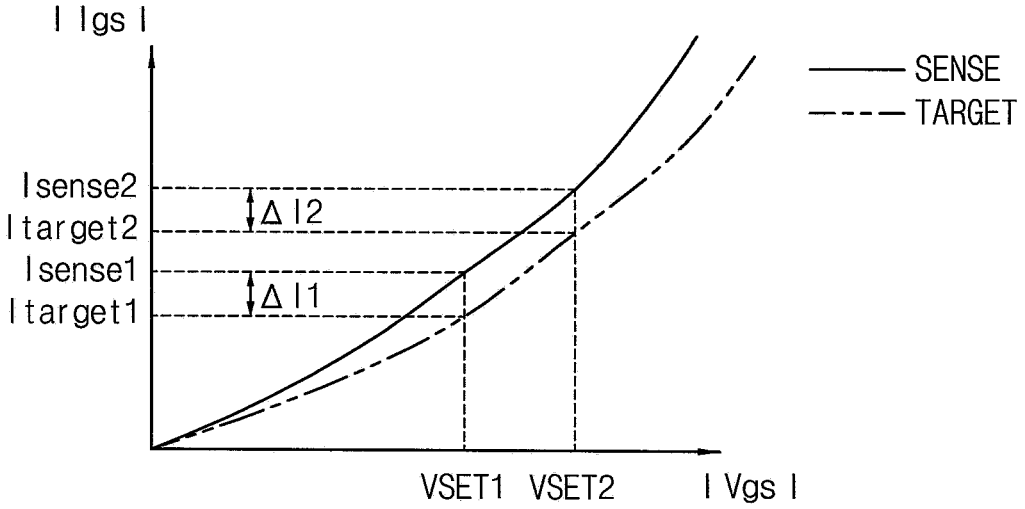

FIG. 4 is a block diagram illustrating an example of a compensator included in an organic light emitting display device of FIG. 1, and FIGS. 5A and 5B are diagrams for describing examples where a compensator of FIG. 4 obtains current differences as hysteresis characteristic values.

Referring to FIGS. 4, 5A, and 5B, a compensator 550 may include a target current storage 510, a current difference calculator 520, a compensation information storage 530, and a data compensator 540.

The target current storage 510 may store target currents TI corresponding to a plurality of gray levels. For example, the target current storage 510 may include a look-up table that stores relationships between the gray levels and the target currents TI, and may provide the current difference calculator 520 with the target currents TI corresponding to the gray levels of data signals provided to test pixels.

The current difference calculator 520 may calculate current differences ΔI between corresponding sensing currents SI and the target currents TI. In some embodiments, as illustrated in FIG. 5A, the current difference ΔI may be obtained by calculating a difference between the target current Itarget and the sensing current Isense flowing through the test pixel at a sensing reference voltage VSET. In other embodiments, as illustrated in FIG. 5B, the current difference ΔI may include a first current difference ΔI1 at a first sensing reference voltage VSET1, and a second current difference ΔI2 at a second sensing reference voltage VSET2. In this case, because a plurality of current differences ΔI1 and ΔI2 are obtained at a plurality of sensing reference voltages VSET1 and VSET2, a compensation value may be more accurately obtained based on the plurality of current differences ΔI1 and ΔI2.

The current difference calculator 520 may calculate the current difference ΔI by subtracting the sensing current SI from the target current TI, and may provide the current difference ΔI to the compensation information storage 530.

The compensation information storage 530 may store the current differences ΔI of the test pixels. In some embodiments, the compensation information storage 530 may include a mapping table that stores identifiers of test pixels to which active pixels are mapped, and a hysteresis characteristic table that stores the current differences of the test pixels having the identifiers. For example, the compensation information storage 530 may search an identifier of a test pixel to which an active pixel is mapped, and may obtain the current difference ΔI of the test pixel having the searched identifier.

The data compensator 540 may obtain the compensation values for the active pixels based on the current difference ΔI of the test pixels to which the active pixels are mapped. The data compensator 540 may generate output image data ODATA by compensating input image data IDATA based on the compensation values. In some embodiments, the data compensator 540 may obtain the compensation values to compensate the input image data IDATA by using a look-up table that stores the compensation values corresponding to respective gray levels of the input image data IDATA and respective current differences ΔI. In other embodiments, the data compensator 540 may obtain the compensation values to compensate the input image data IDATA by using a conversion function. For example, the conversion function may obtain a voltage difference corresponding to the current difference ΔI by using a current-voltage (I-V) curve, and may obtain the compensation value corresponding to the voltage difference using an inverse gamma function.

Figure 6:
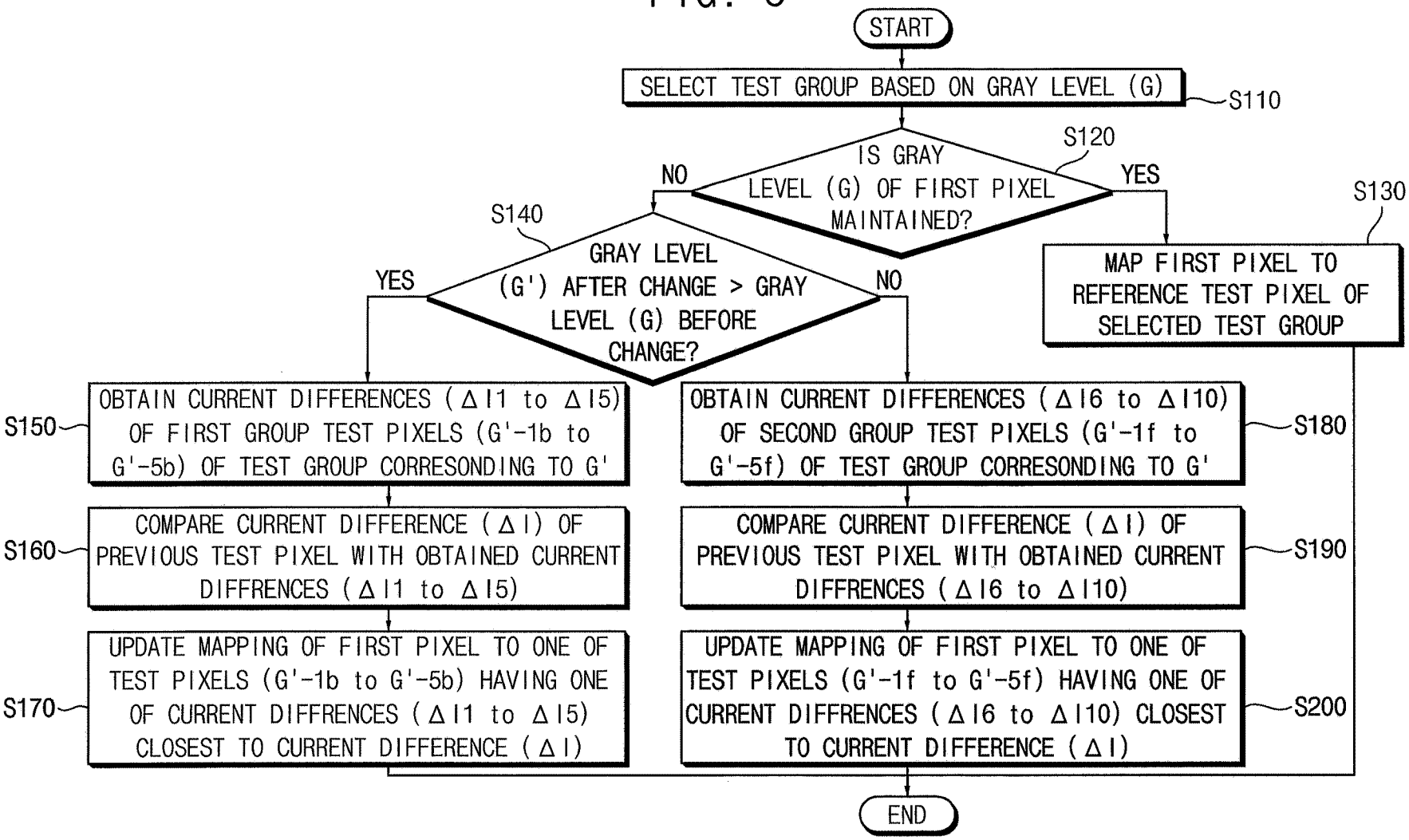
FIG. 6 is a flowchart illustrating an example of mapping between an active pixel and a test pixel.

FIG. 6 is a flowchart illustrating an example of mapping between an active pixel and a test pixel, and FIG. 7 is a diagram for describing an example of test groups.

Referring to FIGS. 6 and 7, because a hysteresis characteristic of an active pixel is changed depending on an operating state, a test pixel to which the active pixel is mapped may be required to be updated in real time. For example, the test pixel to which the active pixel is mapped may be updated based on a change of a data signal applied to the active pixel and a current difference of a test pixel to which the active pixel is mapped.

Further, as illustrated in FIG. 7, to set the test pixels to have various hysteresis characteristics and to properly map the active pixels to the test pixels, data signals or data voltages (e.g., predetermined data signals or predetermined data voltages having predetermined amounts or a predetermined order) may be applied to the test pixels. The test pixels may be grouped into first through N-th test groups TEG1 through TEGn, where N is an integer greater than 1. In an example, the first through N-th test groups TEG1 through TEGn may correspond to all gray levels (e.g., from 0 gray level to 255 gray level), respectively.

In another example, the first through N-th test groups TEG1 through TEGn may correspond to reference gray levels (e.g., predetermined reference gray levels) that are a subset of the set including all possible gray levels. In this case, intervals between the reference gray levels may be set as being relatively narrow in a low gray level region, and may be set as being relatively wide in a high gray level region. For example, in the low gray level region, a first test group TEG1 may have 0 gray level as the reference gray level, a second test group may have 10 gray level as the reference gray level, and a third test group may have 20 gray level as the reference gray level. In the high gray level region, an (N−2)-th test group may have 160 gray level as the reference gray level, an (N−1)-th test group may have 210 gray level as the reference gray level, and an N-th test group TEGn may have 255 gray level as the reference gray level.

In some embodiments, each test group (of second through (N−1)-th test groups) may include a reference test pixel that receives a data signal corresponding to the reference gray level, a first group that alternately receives the data signal corresponding to the reference gray level or a data signal corresponding to a black gray level (e.g., 0 gray level), and a second group that alternately receives the data signal corresponding to the reference gray level or a data signal corresponding to a white gray level (e.g., 255 gray level). The first group may be used for an active pixel of which a gray level is changed from a low gray level to a high gray level (e.g., in a case where a data signal applied to the active pixel is changed from a high data voltage (corresponding to the low gray level) to a low data voltage (corresponding to the high gray level)), and the second group may be used for an active pixel of which a gray level is changed from a high gray level to a low gray level (e.g., in a case where a data signal applied to the active pixel is changed from a low data voltage to a high data voltage). However, in some embodiments, a test group (e.g., TEG1) corresponding to 0 gray level may not include the first group, and a test group (e.g., TEGn) corresponding to 255 gray level may not include the second group.

The respective test pixels included in each of the first group and the second group may be set to receive the data signal having reference gray levels at different timings or at different unit times. The data signal applied to each test pixel may be set or changed on a basis of a unit time (e.g., a predetermined unit time). For example, as illustrated in FIG. 7, a fifth test group TEG5 may include a fifth reference test pixel TEG5-REF (or 48G-REF) that receives the data signal having 48 gray level as the reference gray level, test pixels 48G-1*b*, 48G-2*b*, 48G-3*b*, 48G-4*b* and 48G-5*b* of the first group TEG5-G1 that receive the data signal corresponding to 48 gray level and the data signal corresponding to 0 gray level at different timings, and test pixels 48G-1*f*, 48G-2*f*, 48G-3*f*, 48G-4*f*, and 48G-5*f* of the second group TEG5-G2 that receive the data signal corresponding to 48 gray level and the data signal corresponding to 255 gray level at different timings.

Referring again to FIGS. 6 and 7, a test group corresponding to a first pixel that is the active pixel may be selected among the first through N-th test groups TEG1 through TEGn based on a gray level (G) of the first pixel (S110). For example, in a case where image data for the first pixel has 48 gray level, the fifth test group TEG-G5 corresponding to the 48 gray level may be selected. Further, the first pixel may be mapped to one of the test pixels (e.g., 48G-1*f*) in the fifth test group TEG-G5.

It may be checked whether the gray level (G) of the first pixel is maintained for a given amount of time, or a reference period of time (e.g., 5 unit times) (S120). If the gray level of the first pixel is maintained for the given amount of time (S120: YES), a reference test pixel of a corresponding test group may be set as the test pixel to which the first pixel is mapped (S130). For example, if the input image data for the first pixel are maintained to have the 48 gray level for 5 unit times, the first pixel may be mapped to the reference test pixel 48G-REF of the fifth test group TEG-G5.

If gray level of the first pixel is changed within the given amount of time (S120: NO), an original gray level (e.g., the gray level before the change) (G) of the first pixel and a changed gray level (e.g., the gray level after change) (G') of the first pixel may be compared (S140). If the changed gray level (G') is higher than the original gray level (G) (S140: YES), current differences (ΔI1 to ΔI5) of test pixels (G'-1*b* to G'-5*b*) in a first group of a test group corresponding to the changed gray level (G') may be obtained (S150).

A current difference (ΔI) of a previous test pixel to which the first pixel is previously mapped may be compared with the obtained current differences (ΔI1 to ΔI5) (S160).

Mapping of the first pixel may be updated from the previous test pixel to one of the test pixels (G'-1*b* to G'-5*b*) having one of the current differences (ΔI1 to ΔI5) closest to the current difference (ΔI) of the previous test pixel (S170). For example, if the gray level of the first pixel is changed from the 48 gray level to 63 gray level, mapping of the first pixel may be updated from a previous test pixel (e.g., 48G-1*f*) to one of test pixels 63G-1*b*, 63G-2*b*, 63G-3*b*, 63G-4*b*, and 63G-5*b* in a first group TEG6-G1 of a sixth test group TEG6. Further, to determine the one of the test pixels 63G-1*b*, 63G-2*b*, 63G-3*b*, 63G-4*b*, and 63G-5*b*, current differences (ΔI1 to ΔI5) of the test pixels 63G-1*b*, 63G-2*b*, 63G-3*b*, 63G-4*b*, and 63G-5*b* may be obtained, and the current difference (ΔI) of the previous test pixel (e.g., 48G-1*f*) to which the first pixel is previously mapped may be compared with the obtained current differences (ΔI1 to ΔI5). The first pixel may be newly mapped to one (e.g., 63G-3*b*) of the test pixels 63G-1*b*, 63G-2*b*, 63G-3*b*, 63G-4*b*, and 63G-5*b* having one of the current differences (ΔI1 to ΔI5) closest to the current difference (ΔI) of the previous test pixel (e.g., 48G-1*f*).

Alternatively, if the changed gray level (G') is lower than the original gray level (G) (S140: NO), current differences (ΔI6 to ΔI10) of test pixels (G'-1*f* to G'-5*f*) in a second group of a test group corresponding to the changed gray level (G') may be obtained (S180).

A current difference (ΔI) of the previous test pixel to which the first pixel is previously mapped may be compared with the obtained current differences (ΔI6 to ΔI10) (S190).

Mapping of the first pixel may be updated to from the previous test pixel to one of the test pixels (G'-1*f* to G'-5*f*) having one of the current differences (ΔI6 to ΔI10) closest to the current difference (ΔI) of the previous test pixel (S200). For example, if the gray level of the first pixel is changed from 63 gray level to 48 gray level, mapping of the first pixel may be updated from a previous test pixel (e.g., 63G-3*b*) to one of test pixels 48G-1*f*, 48G-2*f*, 48G-3*f*, 48G-4*f*, and 48G-5*f* in a second group TEG5-G2 of a fifth test group TEG5. Further, to determine the one of the test pixels 48G-1*f*, 48G-2*f*, 48G-3*f*, 48G-4*f*, and 48G-5*f*, current differences (ΔI6 to ΔI10) of the test pixels 48G-1*f*, 48G-2*f*, 48G-3*f*, 48G-4*f*, and 48G-5*f* may be obtained, and the current difference (ΔI) of the previous test pixel (e.g., 63G-3*b*) may be compared with the obtained current differences (ΔI6 to ΔI10). The first pixel may be newly mapped to one (e.g., 48G-2*f*) of the test pixels 48G-1*f*, 48G-2*f*, 48G-3*f*, 48G-4*f*, and 48G-5*f* having one of the current differences (ΔI6 to ΔI10) that is closest to the current difference (ΔI) of the previous test pixel (e.g., 63G-3*b*).

In some embodiments, mapping of the first pixel may be updated every frame period. In other embodiments, mapping of the first pixel may be updated with an interval of a plurality of frame periods.

Figure 8:
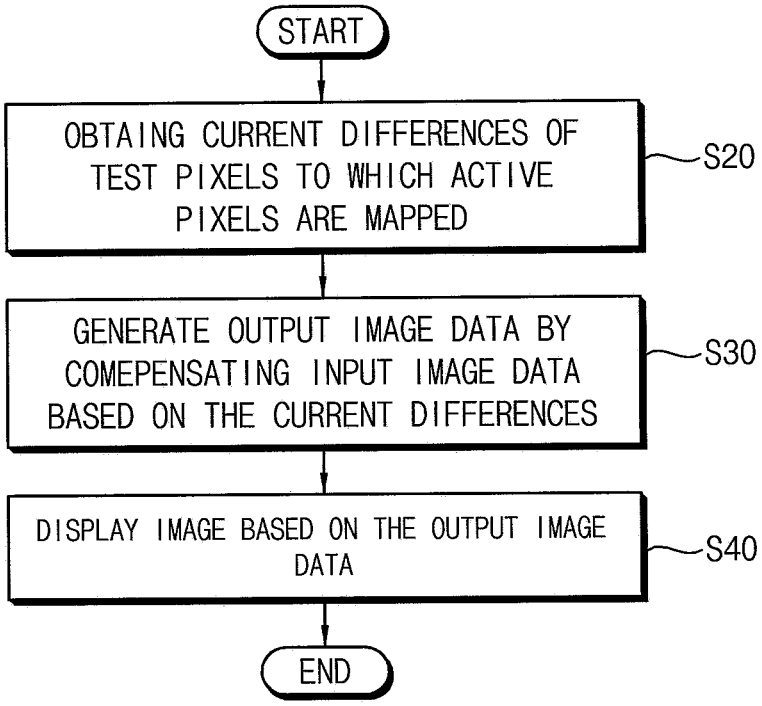
FIG. 8 is a flowchart illustrating a method of driving an organic light emitting display device according to embodiments.
Figure 9:
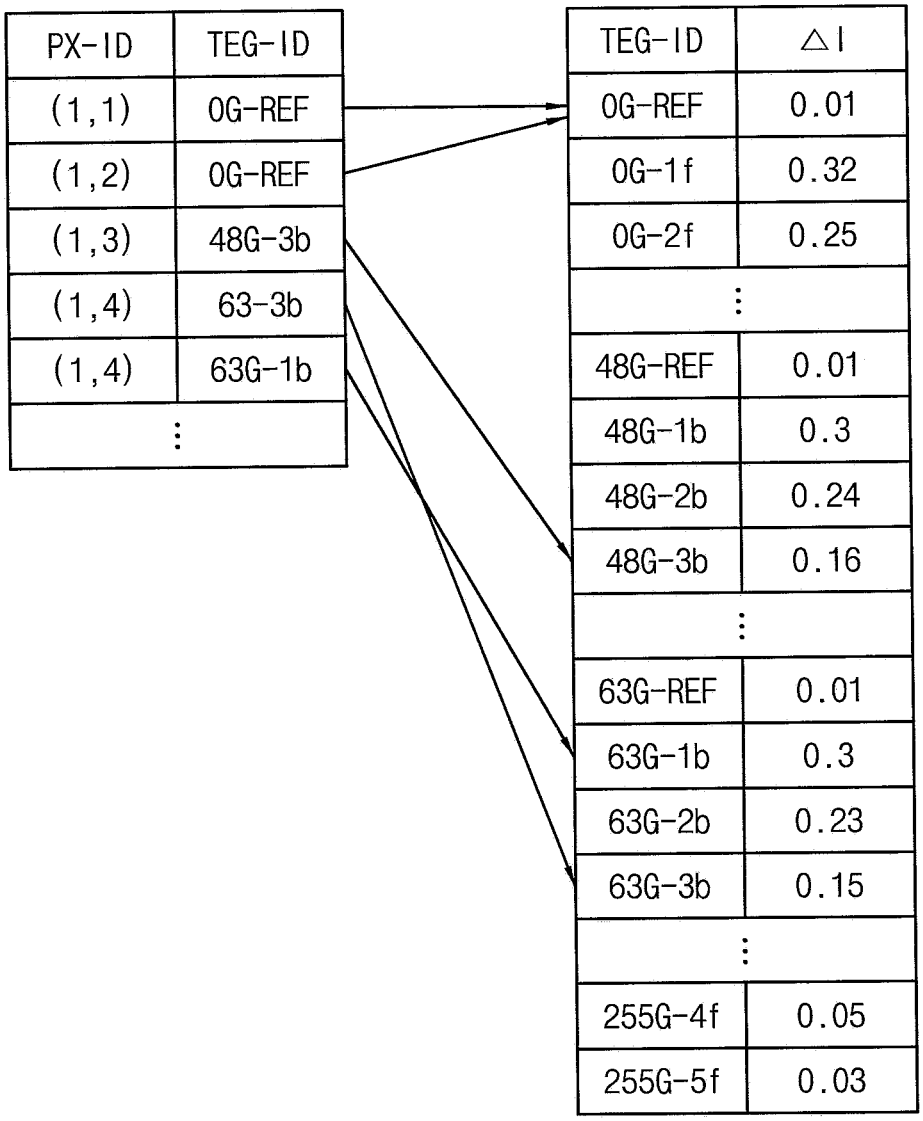
FIG. 9 is a diagram for describing a method of performing compensation using current differences of test pixels to which active pixels are mapped.

FIG. 8 is a flowchart illustrating a method of driving an organic light emitting display device according to embodiments, and FIG. 9 is a diagram for describing a method of performing compensation using current differences of test pixels to which active pixels are mapped.

Referring to FIGS. 8 and 9, in a method of driving an organic light emitting display device where test pixels are located in a non-display region of a display panel, hysteresis compensation for active pixels may be performed based on sensing current values of the test pixels corresponding to the active pixels.

In the method, the organic light emitting display device may obtain hysteresis characteristic values of the test pixels to which the active pixels are mapped (S20). In some embodiments, the hysteresis characteristic values may correspond to current differences between sensing currents from the test pixels and target currents. For example, as illustrated in FIG. 9, the organic light emitting display device may use a mapping table MT that stores identifiers of the test pixels to which the active pixels are mapped and a hysteresis characteristic table HT that stores current differences of the test pixels. In some embodiments, the mapping table MT may store identifiers (or addresses) PX-ID of the active pixels and the identifiers TEG-ID of the test pixels to which the active pixels are mapped. Further, the hysteresis characteristic table HT may store the identifiers TEG-ID of the test pixels and the current differences ΔI of the test pixels having the identifiers TEG-ID. Thus, the organic light emitting display device may obtain the identifier of the test pixel to which the active pixel is mapped by using the mapping table MT, and may obtain the current difference of the test pixel having the obtained identifier by using the hysteresis characteristic table HT.

Because the hysteresis characteristic of the active pixel is changed depending on an operating state (e.g., a data signal or voltage previously applied to the active pixel), the test pixel to which the active pixel is mapped may be required to be updated in real time. The mapping of the active pixel to the test pixel may be updated based on a change of the data signal applied to the active pixel and current differences of the test pixels.

In some embodiments, the test pixels may be grouped into first through N-th test groups, and each test group may include a reference test pixel that receives a data signal corresponding to a reference gray level, a first group that alternately receives the data signal corresponding to the reference gray level and a data signal corresponding to a black gray level (e.g., 0 gray level), and a second group that alternately receives the data signal corresponding to the reference gray level or a data signal corresponding to a white gray level (e.g., 255 gray level). In some embodiments, a gray level for a first pixel of the active pixels in a current period may be extracted from input image data, a test group corresponding to the first pixel may be selected based on the gray level in the current period, one of a first group and a second group of the selected test group may be further selected by comparing the gray level in the current period and a gray level for the first pixel in a previous period before the current period, and the test pixel to which the first pixel is mapped may be updated from a previous test pixel to an updated test pixel such that the updated test pixel has a closest current difference to a current difference of the previous test pixel among the current differences of the test pixels in the selected one of the first group and the second group.

In some embodiments, if a gray level of a first pixel of the active pixels is maintained (e.g., maintained during a predetermined period), the first pixel may be mapped to a reference test pixel of the selected test group. However, a method of grouping the test pixels and a method of applying data voltages to the test pixels are described above, and duplicated descriptions will be omitted.

The organic light emitting display device may generate output image data by compensating input image data for the active pixels based on the obtained current differences (or hysteresis characteristic values) (S30). In some embodiments, compensation values may be obtained using a look-up table that stores the compensation values corresponding to respective gray levels of the input image data and the current differences, and the output image data may be generated by compensating the input image data using the compensation values. In other embodiments, the compensation values may be obtained using a conversion function. However, a method of compensating the input image data using the hysteresis characteristic values is described above, and duplicated descriptions will be omitted.

The organic light emitting display device may display an image based on the output image data (S40).

Figure 10A:
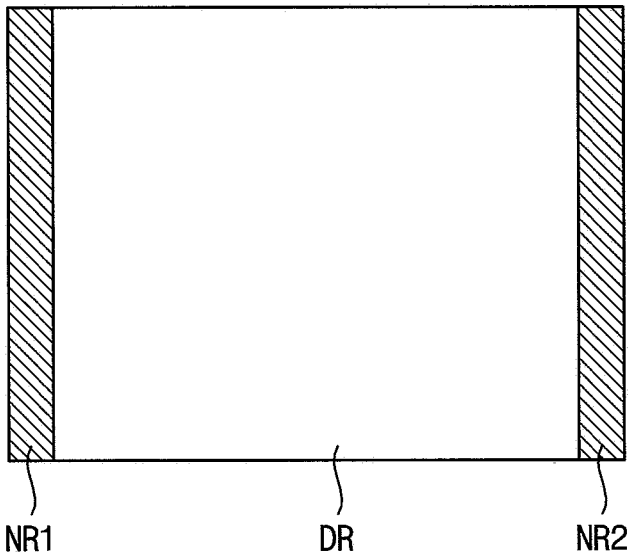
FIGS. 10A through 10C are diagrams for describing examples of arrangements of test pixels included in an organic light emitting display device of FIG. 1.
Figure 10B:
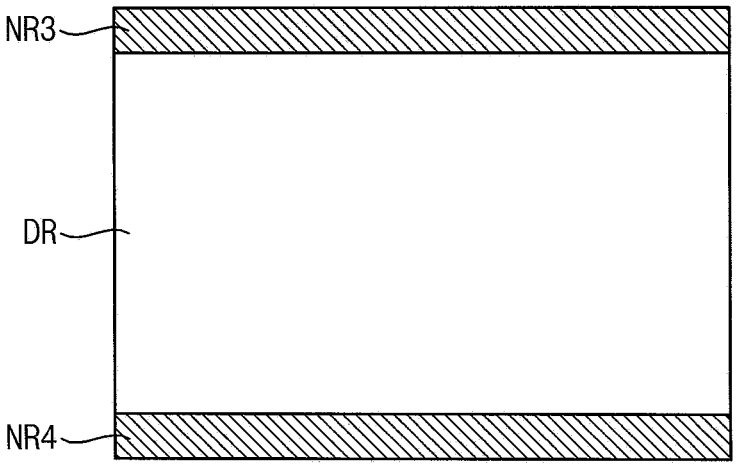
Figure 10C:
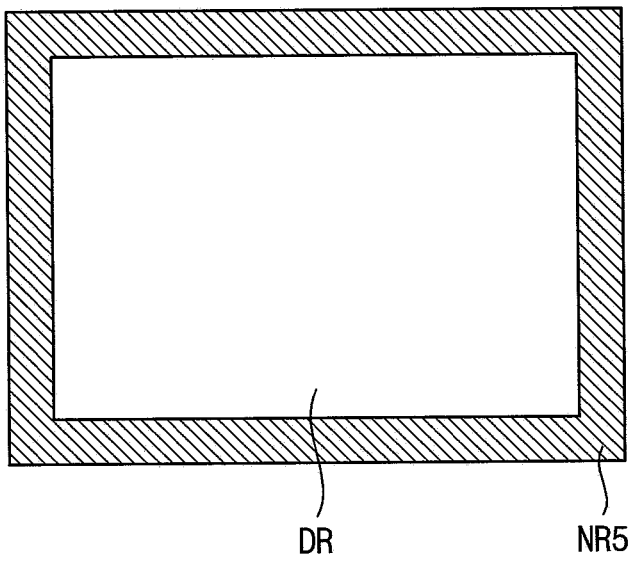

FIGS. 10A through 10C are diagrams for describing examples of arrangements of test pixels included in an organic light emitting display device of FIG. 1.

Referring to FIGS. 10A through 10C, test pixels may be located in one or more non-display regions NR1, NR2, NR3, NR4, and NR5 of a display panel.

The non-display region NR1, NR2, NR3, NR4, and NR5 may be adjacent to at least one edge of a display region DR.

In some embodiments, as illustrated in FIG. 10A, the non-display region NR1 and NR2 may be located adjacent to a left edge and/or a right edge of the display region DR such that the test pixels are arranged along a pixel column direction. In this case, the number of an integrator and an ADC included in a readout circuit may be reduced.

In other embodiments, as illustrated in FIG. 10B, the non-display region NR3 and NR4 may be located adjacent to a top edge and/or a bottom edge of the display region DR such that the test pixels are arranged along a pixel row direction. In this case, sensing currents flowing through the test pixels may be rapidly measured.

In still other embodiments, as illustrated in FIG. 10C, the non-display region NR5 may surround the display region DR. In this case, the number of the test pixels may be increased to more accurately sense hysteresis characteristics and to more accurately compensate for a panel deviation.

The inventive concepts may be applied to an organic light emitting display device and any electronic device including the organic light emitting display device. For example, the inventive concepts may be applied to a television (TV), a digital TV, a 3D TV, a smart phone, a mobile phone, a tablet computer, a personal computer (PC), a home appliance, a laptop computer, a personal digital assistant (PDA), a portable multimedia player (PMP), a digital camera, a music player, a portable game console, a navigation device, etc.

The foregoing is illustrative of embodiments and is not to be construed as limiting thereof. Although a few embodiments have been described, those skilled in the art will readily appreciate that many modifications are possible in the embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various embodiments and is not to be construed as limited to the specific embodiments disclosed, and that modifications to the disclosed embodiments, as well as other embodiments, are intended to be included within the scope of the appended claims, with functional equivalents thereof to be included.

What is claimed is:

1. An organic light emitting display device comprising:

a display panel comprising a plurality of active pixels in a display region, and a plurality of test pixels in a non-display region;

a panel driver configured to provide the test pixels with data signals corresponding to a plurality of gray levels, and to drive the display panel;

a readout circuit configured to measure sensing currents flowing through the test pixels; and a controller configured to obtain hysteresis characteristic values of the test pixels based on the sensing currents, to generate output image data by compensating input image data for the active pixels based on the hysteresis characteristic values of the test pixels to which the active pixels are mapped, and to control the panel driver to display an image based on the output image data.

2. The organic light emitting display device of claim 1, wherein the hysteresis characteristic values correspond to current differences between the sensing currents and target currents.

3. The organic light emitting display device of claim 2, wherein the test pixels are grouped into first through N-th test groups, where N is an integer that is greater than 1, and wherein each test group comprises a reference test pixel for receiving a data signal corresponding to a reference gray level, a first group for alternately receiving the data signal corresponding to the reference gray level and a data signal corresponding to a black gray level, and a second group for alternately receiving the data signal corresponding to the reference gray level and a data signal corresponding to a white gray level.

4. The organic light emitting display device of claim 3, wherein a gray value for a first pixel of the active pixels in a current period is extracted from the input image data, and a selected test group corresponding to the first pixel is selected among the first through N-th test groups based on the gray value in the current period, wherein a selected one of the first group and the second group of the selected test group is further selected by comparing the gray value in the current period and a gray value in a previous period before the current period, and wherein the test pixel to which the first pixel is mapped is updated from a previous test pixel to an updated test pixel in the selected one of the first group and the second group such that the updated test pixel has a closest current difference to a current difference of the previous test pixel among current differences of the test pixels in the selected one of the first group and the second group.

5. The organic light emitting display device of claim 3, wherein a gray value for a first pixel of the active pixels is extracted from the input image data, and a selected test group corresponding to the first pixel is selected among the first through N-th test groups based on the gray value, and wherein, when the gray value for the first pixel is maintained for a reference period of time, the test pixel to which the first pixel is mapped is updated to the reference test pixel of the selected test group.

6. The organic light emitting display device of claim 1, wherein the controller comprises:

a target current storage configured to store target currents corresponding to the plurality of gray levels;

a current difference calculator configured to calculate current differences between the sensing currents and the target currents;

a compensation information storage configured to store the current differences of the test pixels; and a data compensator configured to obtain compensation values for the active pixels based on the current differences of the test pixels to which the active pixels are mapped, and to compensate the input image data based on the compensation values.

7. The organic light emitting display device of claim 6, wherein the compensation information storage comprises:

a mapping table configured to store identifiers of the test pixels to which the active pixels are mapped; and a hysteresis characteristic table configured to store the current differences of the test pixels having the identifiers.

8. The organic light emitting display device of claim 7, wherein the current difference of each test pixel comprises a first current difference obtained at a first sensing reference voltage and a second current difference obtained at a second sensing reference voltage that is different from the first sensing reference voltage.

9. The organic light emitting display device of claim 1, wherein the non-display region surrounds the display region.

10. The organic light emitting display device of claim 1, wherein the non-display region is adjacent to at least one edge of the display region.

11. The organic light emitting display device of claim 1, wherein the readout circuit is configured to measure the sensing currents every frame period, and wherein the test pixels to which the active pixels are mapped are configured to be updated every frame period.

12. The organic light emitting display device of claim 1, wherein the readout circuit is configured to measure the sensing currents with an interval of a plurality of frame periods, and wherein the test pixels to which the active pixels are mapped are configured to be updated with the interval of the plurality of frame periods.

13. A method of driving an organic light emitting display device comprising a display panel, a panel driver, a readout circuit, a plurality of active pixels in a display region, and a plurality of test pixels in a non-display region, the method comprising:

providing the test pixels with data signals corresponding to a plurality of gray levels and driving the display panel with the panel driver;

measuring sensing currents flowing through the test pixels with the readout circuit;

obtaining hysteresis characteristic values of the test pixels based on sensing currents flowing through the test pixels;

generating output image data by compensating input image data for the active pixels based on the hysteresis characteristic values of the test pixels to which the active pixels are mapped; and displaying an image based on the output image data.

14. The method of claim 13, wherein the hysteresis characteristic values correspond to current differences between the sensing currents and target currents.

15. The method of claim 13, wherein the test pixels are grouped into first through N-th test groups, where N is an integer that is greater than 1, and wherein each test group comprises a reference test pixel that receives a data signal corresponding to a reference gray level, a first group that alternately receives the data signal corresponding to the reference gray level and a data signal corresponding to a black gray level, and a second group that alternately receives the data signal corresponding to the reference gray level and a data signal corresponding to a white gray level.

16. The method of claim 15, further comprising:

extracting a gray value for a first pixel of the active pixels in a current period from the input image data;

selecting a test group corresponding to the first pixel among the first through N-th test groups based on the gray value in the current period;

selecting one of the first group and the second group of the selected test group by comparing the gray value in the current period and a gray value in a previous period before the current period; and updating the test pixel to which the first pixel is mapped from a previous test pixel to a updated test pixel in the selected one of the first group and the second group such that the updated test pixel has a closest current difference to a current difference of the previous test pixel among current differences of the test pixels in the selected one of the first group and the second group.

17. The method of claim 15, further comprising:

extracting a gray value for a first pixel of the active pixels from the input image data;

selecting a test group corresponding to the first pixel among the first through N-th test groups based on the gray value; and updating the test pixel to which the first pixel is mapped to the reference test pixel of the selected test group when the gray value for the first pixel is maintained for a predetermined time.

18. The method of claim 13, wherein obtaining the hysteresis characteristic values comprises:

obtaining the test pixels to which the active pixels are mapped by using a mapping table that stores identifiers of the test pixels to which the active pixels are mapped; and obtaining current differences of the test pixels to which the active pixels are mapped by using a hysteresis characteristic table that stores the current differences of the test pixels having the identifiers.

19. The method of claim 18, wherein the current difference of each test pixel comprises a first current difference obtained at a first sensing reference voltage and a second current difference obtained at a second sensing reference voltage that is different from the first sensing reference voltage.

20. The method of claim 18, further comprising:

measuring the sensing currents every frame period; and updating the test pixels to which the active pixels are mapped every frame period.

* * * * *